US006293507B1

(12) United States Patent
Gorniak

(10) Patent No.: US 6,293,507 B1
(45) Date of Patent: Sep. 25, 2001

(54) ADJUSTABLE SHELF HANGING CLIP

(75) Inventor: Theodore S. Gorniak, North East, PA (US)

(73) Assignee: Ridg-U-Rak, Inc.

( * ) Notice: Subject to any disclaimer, the term of this patent is extended or adjusted under 35 U.S.C. 154(b) by 0 days.

(21) Appl. No.: 09/415,634

(22) Filed: Oct. 12, 1999

Related U.S. Application Data

(60) Provisional application No. 60/104,533, filed on Oct. 16, 1998.

(51) Int. Cl.[7] ..... A47G 29/02

(52) U.S. Cl. ..... 248/243; 248/220.43; 211/187; 211/183

(58) Field of Search ..... 248/243, 247, 248/248, 220.31, 220.41, 220.43, 225.11, 225.21; 211/187, 189, 192, 183; 108/107; D8/349, 354, 373

(56) References Cited

U.S. PATENT DOCUMENTS

| | | | | |
|---|---|---|---|---|
| D. 392,551 | | 3/1998 | Brady et al. | D8/373 |
| D. 393,164 | | 4/1998 | Russell et al. | D6/509 |
| 1,376,835 | | 5/1921 | Shiek | 108/185 |
| 2,788,949 | | 4/1957 | Gurries | 248/242 |
| 3,085,693 | | 4/1963 | Shell | 211/134 |
| 3,100,572 | | 8/1963 | Gingher et al. | 211/153 |
| 3,565,381 | | 2/1971 | Oliver | 248/243 |
| 3,580,398 | | 5/1971 | Schafer | 211/148 |
| 3,794,281 | | 2/1974 | Munsey | 248/188 |
| 4,027,453 | | 6/1977 | Bridge | 403/353 |
| 4,154,419 | * | 5/1979 | Breidenbach | 248/243 |
| 4,180,003 | | 12/1979 | Clement | 108/144 |
| 4,348,001 | | 9/1982 | Baldwin | 248/243 |
| 4,349,171 | | 9/1982 | Baldwin | 248/243 |
| 4,405,052 | * | 9/1983 | Spiros | 211/187 |
| 4,423,978 | * | 1/1984 | Tiegelmann | 248/224.41 X |
| 4,515,494 | | 5/1985 | Robilliard et al. | 403/187 |
| 4,553,725 | | 11/1985 | Vargo | 248/221.3 |
| 4,712,696 | | 12/1987 | Klein | 211/192 |
| 5,277,393 | | 1/1994 | Nicholson et al. | 248/243 |
| 5,632,389 | | 5/1997 | Rosenband | 211/187 |
| 5,695,163 | | 12/1997 | Tayar | 248/243 |
| 5,797,502 | * | 8/1998 | Bradey et al. | 211/187 X |
| 5,975,318 | * | 11/1999 | Jay | 211/187 X |

* cited by examiner

*Primary Examiner*—Anita King
*Assistant Examiner*—Gwendolyn Baxter
(74) *Attorney, Agent, or Firm*—Edward W. Goebel, Jr.; MacDonald, Illig, Jones & Britton, LLP

(57) ABSTRACT

An adjustable, shelf hanging clip for hanging shelves on storage racks is constructed from at least two rectangular sections of material joined at an angle which can be about 90°. At least one of these rectangular sections has a pair of hook-shaped support and latching tabs extending from its exterior surface, with the ends of the tabs extending toward one another. The hook shaped tabs are adapted to be received into a pair of adjacent, vertically spaced holes in the columns of the storage racks. The hook of the upper tab fits over the bottom of the upper hole so that the top inside surface of the hook is the bearing surface and the outside surface of the lower tab is the bearing surface on the bottom of the lower hole. The other rectangular section of the clip has a notch at each of its ends. The bottom surface of each notch is a separate, preselected longitudinal distance from the inside bearing surface of the nearest tab. Thus, the clip can be turned around and installed in the same vertically spaced holes on storage rack columns to adjust the height of the storage rack. The clip can have additional adjustment heights by fabricating an additional pair of similarly arranged hook tabs on each of one or more additional rectangular sections of the clip and cutting notches in the ends of adjacent rectangular sections which are additional, different longitudinal distances from the inside bearing surfaces of these tabs.

13 Claims, 5 Drawing Sheets

ADJUSTABLE SHELF HANGING CLIP

This application claims the benefit of Prov. No. 60/104,533 filed Oct. 16, 1998.

BACKGROUND OF THE INVENTION

This invention relates to shelf hanging clips, and more particularly, to shelf hanging clips for mounting shelves on vertical columns of storage rack systems.

Storage rack systems are designed to provide for the storage of items either on storage pallets placed on the racks, or on one of a variety of types of shelves mounted between vertical columns of the storage racks. When items are to be stored on shelves, many types of mechanisms are used to hang the shelves between the vertical columns of the racks. Some of these shelf hanging mechanisms are fastened to the vertical columns through the use of nuts and bolts installed through shelf adjustment holes on the sides of the columns. While nuts and bolts work well as fasteners, they are inconvenient to install and lengthen the time required for installation for shelves while nuts are being tightened onto the bolts.

Numerous types of single case shelf hanging clips and brackets had been devised which have hooks or tabs to connect to vertical rack columns, rather than use nuts and bolts to do so. These hooks or tabs on the shelf hanging clips typically fit into adjacent shelf adjustment holes in the vertical columns to latch onto the columns and support shelves on which items are to be stored. Typical shelf hanging clips and brackets of this type are shown in U.S. Pat. Nos. 4,180,003 Clement, 4,348,001 Baldwin, and Des. 392,551 Brady, et al.

One use of these shelf hanging clips and brackets is to support inclined gravity flow shelves which are installed on storage racks to be used for an order picking system. The inclined shelves often include tracks of rollers which enable cartons being stored to flow to the lower ends of the shelves as other cartons are removed.

Typically, shelf adjustment holes in vertical rack columns are spaced two or three inches apart. It is often desirable to give the shelf installers the option to make adjustments of less than two inches in the height of an end of shelves to adjust the angle of incline of inclined shelves being installed. Using vertical columns having shelf adjustment holes with two-inch spacing by way of illustration, shelf installers may need the flexibility of mounting shelves even with the shelf adjusting holes or one-half inch, one inch or one and one-half inches above these holes.

Shelf hanging mechanisms using nuts and bolts can make these adjustments by having a series of holes at various heights in them through which bolts can be inserted. The height at which a shelf or one end of a shelf is installed can be adjusted by changing the holes into which installation bolts are inserted in the shelf hanging mechanisms. Shelf hanging clips and brackets not using nuts and bolts to attach to rack columns normally cannot make small adjustments in the position at which they are mounted.

A universal hanger bracket shown in U.S. Pat. Des. 392,551 Brady, et al partially solves the need for a clip or bracket having flexibility in adjusting the incline of inclined shelves. A hanger bracket 20 depicted in the Brady, et al patent is show n in FIG. 1. The hanger bracket 20 is U-shaped so that it is made up of three rectangular metallic plate sections consisting of end section 22, middle section 24, and end section 26. Each of these rectangular sections 22, 24, and 26 is joined to an adjacent rectangular section at a corner due to the bending of the plate during the manufacture of the U-shaped hanger bracket 20. Thus, the rectangular section 22 is connected through the corner 28 to the rectangular section 24. The rectangular 24, itself, is connected through a corner 30 to the rectangular section 26.

Each of the rectangular sections 22 and 26 has a pair of tabs punched out of the plate which makes up these sections so as to extend through the outside surface of the U-shaped hanger bracket 20. Thus, tabs 32 and 34 extend from an outside surface 35 of the rectangular section 22, and tabs 36 and 38 extend from an outside surface 39, only an edge of which is shown in FIG. 1, of the rectangular section 26 of the U-shaped hanger bracket 20. Each of the tabs is hook-like in shape, with the ends of tabs 32 and 34 and the ends of the tabs 36 and 38 all extending in one vertically downward direction, as shown in FIG. 1. The rectangular section 24 has a notch 40 shown in FIG. 1, its upper end which is proximate to tabs 32 and 36. The purpose of the notch 40 is to receive and retain the bottom of one side of a shelf being supported by the hanger bracket 20 on bottom surface 42 of the notch 40.

As explained above, the set of tabs 32 and 34 and the set of tabs 36 and 38 are designed to fit into vertically adjacent holes in a vertical rack column to latch the U-shaped hanger bracket 20 onto the column to enable it to support a shelf. Each of the tabs has a bearing surface, which is the flat, upper portion of the underside of the hook-like structure of the tab. The bearing surface contacts the bottom of a shelf adjustment hole into which the tab is inserted. Thus, tab 32 has a bearing surface 44, tab 34 has a bearing surface 46, tab 36 has a bearing surface 48, and tab 38 has a bearing surface 50. The tabs 32 and 34 are spaced apart at a distance equal to the distance between the adjacent shelf adjustment holes in the vertical rack columns, as are the tabs 36 and 38. The tabs 32, 34, 36 and 38 all have a size which enables them to fit through the shelf adjustment holes and around the steel plate out of which the columns are manufactured. As a result the bearing surfaces 44 and 46 contact the bottom of shelf adjustment holes when the tabs 34 and 36, respectively, are inserted into the holes, and the bearing surfaces 48 and 50 contact the bottom of shelf adjustment holes when the tabs 36 and 38, respectively, are inserted into the holes.

As shown in FIG. 1, the bearing surface 44 of the tab 32 is at about the same height on rectangular section 22 as the bottom surface 42 is on rectangular section 24. The bearing surface 46 of the tab 34 is, thus, a distance below the bottom surface 42 equal to the distance between adjacent shelf adjustment holes in the vertical column in which the hangar bracket 20 is to be mounted. As a result, when the tabs 32 and 34 are used to latch the hanger bracket 20 onto a vertical rack column, the bottom surface 42 of the notch 40, which supports a shelf, is at the height of the shelf adjustment hole through which the tab 32 extends. The tab 34 assists in supporting the hanger bracket by latching onto a shelf adjustment hole below the hole through which the tab 32 extends.

The bearing surface 48 of the tab 36, on the other hand, is a preselected distance below the bottom surface 42 of the notch 40. Thus, the bearing surface 50 of the tab 38 is below the bottom surface 42 of the notch 40 by a distance equal to the preselected distance, plus the distance between the shelf adjustment holes into which the tabs 36 and 38 are to be inserted. For this reason, when the tabs 36 and 38 are used to latch the hanger bracket 20 onto a vertical column of a rack system, the bottom surface 42 is the preselected distance above the shelf adjustment hole in which tab 36 is mounted.

As a result of the structure described above, the U-shaped hanger bracket 20 can hold a shelf within the notch 40 at either of two levels: At the level of the shelf adjustment hole in which the tab 32 is mounted, or at a predetermined level above that hole when the tab 36 is mounted in it. While the U-shaped hanger bracket 20 provides two heights at which shelves can be mounted within a particular shelf adjustment hole, there are shelf installations when additional adjustments are needed. Prior to this invention the only way to obtain additional height adjustments was to provide shelf installers with separate hanger brackets having tabs set at different distances from the bottom surface of the notches at the tops of these brackets.

SUMMARY

The adjustable shelf hanging clip of this invention comprises a plurality of generally rectangular sections of plate or other material out of which the clip is constructed. The plurality of rectangular sections includes a first rectangular section joined to a second rectangular section through a corner to form an angle of less than 180°. For most applications of this invention the angle between the first and second rectangular sections will be 90°. The first rectangular section includes first and second support and latching tabs located in a line with one another which is parallel with the corner. Each of the tabs extends from a surface of the first rectangular section which is exterior of the angle between the rectangular sections. Additionally, the end of each of the tabs extends in a direction toward the other tab.

The second rectangular section has a first end which is proximate the first tab of the first rectangular section and has a second end which is proximate the second tab of the first rectangular section. The first end of the second rectangular section has a first notch with a bottom surface which is a first preselected longitudinal distance from the first tab. The second end of the second rectangular section has a second notch with a bottom surface which is a second preselected longitudinal distance from the second tab.

When the first tab is inserted into a shelf adjustment hole of a vertical rack column, the bearing surface of the first tab which rests on the bottom surface of the hole is the upper inside surface of the first tab. Since the tabs are facing one another, the bearing surface of the second tab which rests on the bottom surface of the shelf adjustment hole into which the second tab is inserted, is the lower outside surface of the second tab, that is the closest surface to the outside surface of the first rectangular section. In other words, the first tab latches onto the column material while extending through a shelf adjustment hole and also helps support the load on the shelf hanging clip. The second tab, however, only helps support the load on the clip and does not latch onto the column.

When the first tab on the first rectangular section of the shelf hanging clip is inserted into a shelf adjustment hole, the bottom surface of the first notch on one end of the second rectangular section is the first predetermined distance away from the bottom of the shelf adjusting hole. When the shelf hanging clip is turned over, it is the second tab which latches through a shelf adjusting hole and onto a column. The upper inside surface of the second tab becomes the bearing surface of that tab. Since the two tabs extend toward one another, the lower outside surface of the first tab, that is the outside surface of the first tab closest to the outside surface of the first rectangular section, is now the bearing surface of that tab. The bottom surface of the second notch of the second rectangular section supports a shelf at the second predetermined distance above the lower surface of the shelf adjustment hole in which the second tab is now inserted.

Thus, two heights are available for mounting a shelf using only a single pair of tabs extending toward one another on one rectangular section of an L-shaped shelf hanging clip, along with having a notch in both ends of the other rectangular section of the clip. The number of shelf mounting heights available can be doubled by including a second pair of tabs which extend toward one another in the second rectangular section of the L-shaped shelf hanging clip, along with including a notch at each end of the first rectangular section of the clip.

The number of shelf mounting heights can be extended to six by making the adjustable shelf hanging clip of this invention U-shaped. Each of these rectangular sections would have a pair of tabs extending from its outside surface with the ends of the tabs extending toward one another, and each of these sections would have a notch cut out of both of its ends. In whichever end of the adjustable mounting clip that is at the top, the lower bearing surface of the top tab of each rectangular section should be a different longitudinal distance from the bottom surface of the proximate notch in the adjacent rectangular section than the distance the lower surface of any other tab is from the bottom surface of the proximate notch in an adjacent section. Since there are six tabs available for latching when the clip is turned from one end to the other, there are six adjustments available for the height of a shelf being supported by a U-shaped shelf mounting clip made in accordance with this invention.

Important features of this invention are disclosed in the detailed Description of the Preferred Embodiment shown and described below. However, the appended claims are intended to be interpreted to cover equivalent shelf hanging clips which do not depart from the spirit and scope of this invention.

DESCRIPTION OF THE PREFERRED EMBODIMENT

Figure 1:
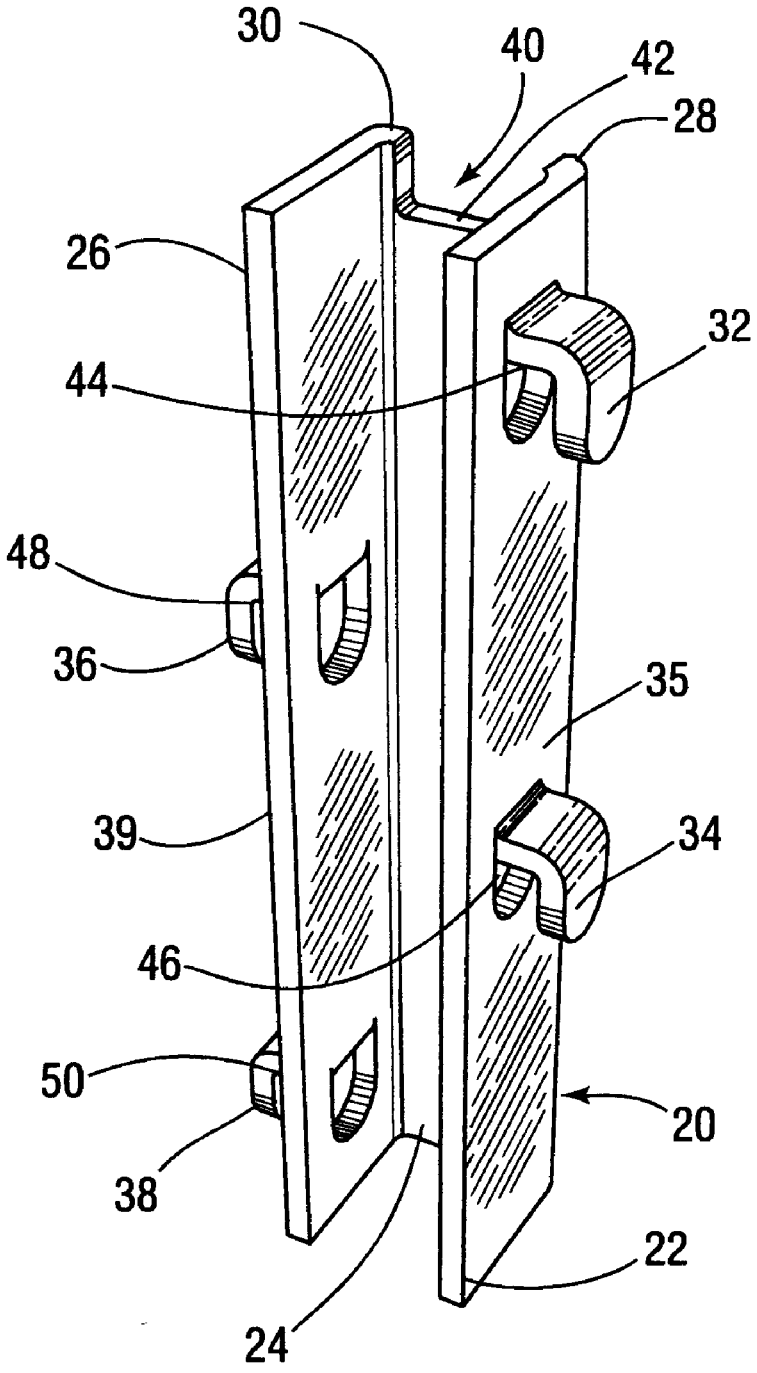
Prior Art Fig.1
FIG. 1 is a perspective view of a prior art U-shaped hanger bracket.

Referring to the drawings, identical reference numerals and letters designate the same or corresponding items throughout the several figures shown in the drawings, as well.

Figure 2:
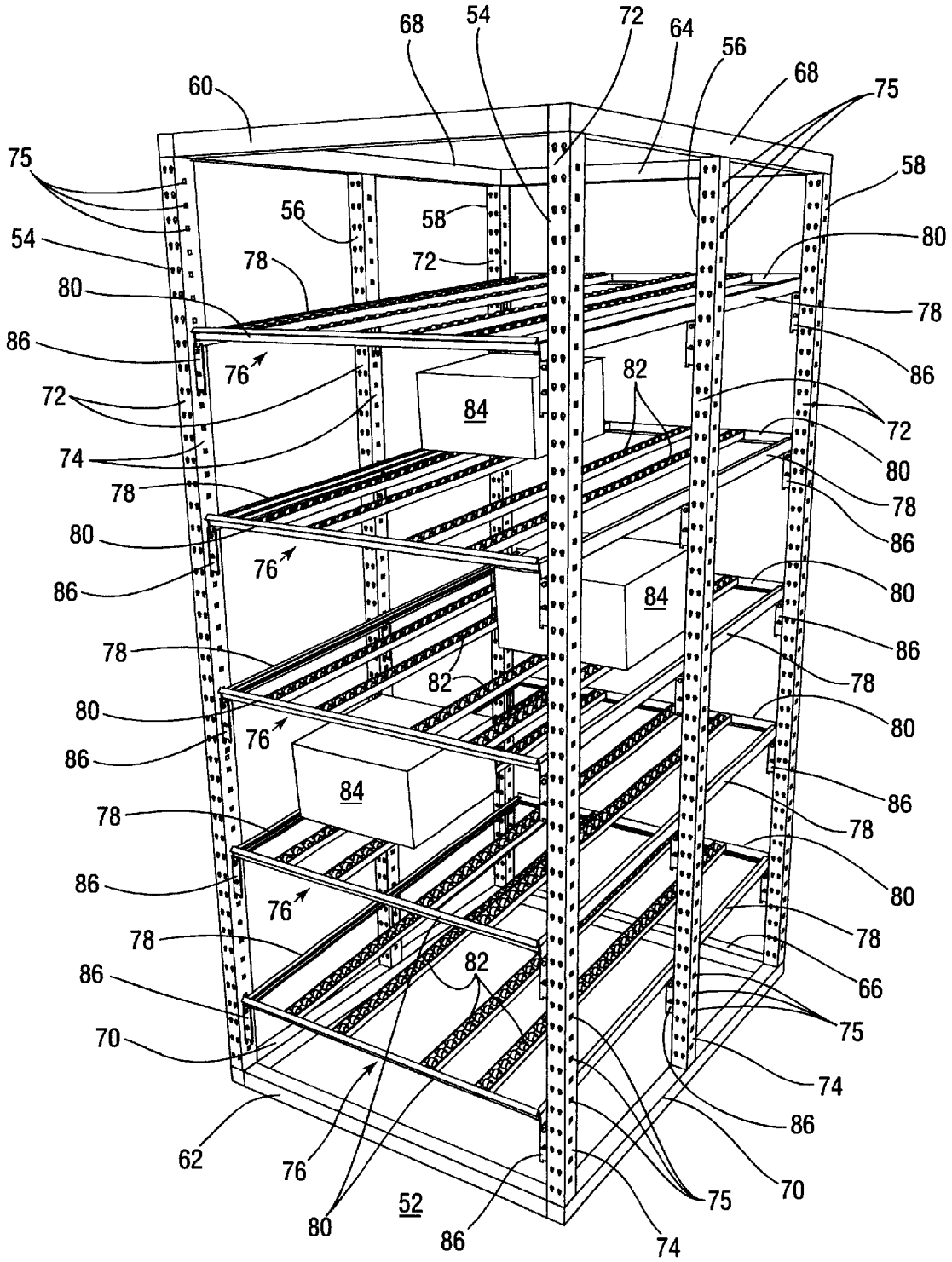
FIG. 2 is a perspective view of a storage rack system using shelf hanging clips made in accordance with this invention.
Figure 3:
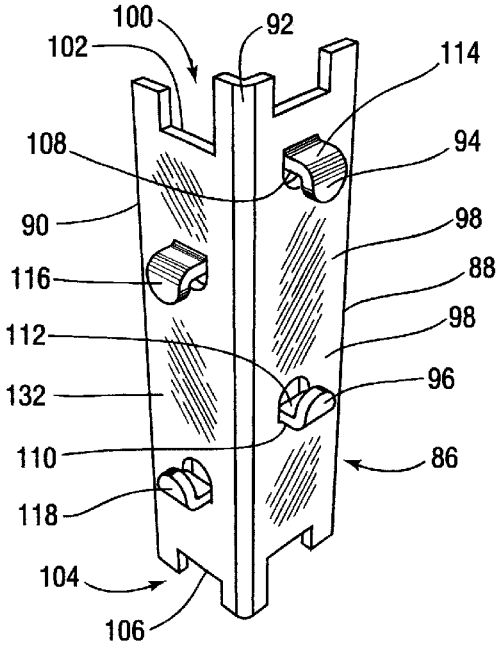
FIG. 3 is a perspective view of an L-shaped shelf hanging clip made in accordance with this invention.
Figure 4:
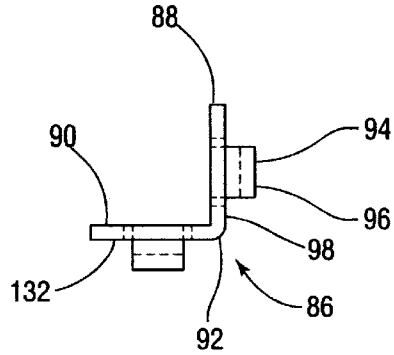
FIG. 4 is a top view of the L-shaped shelf hanging clip shown in FIG. 3.
Figure 5:
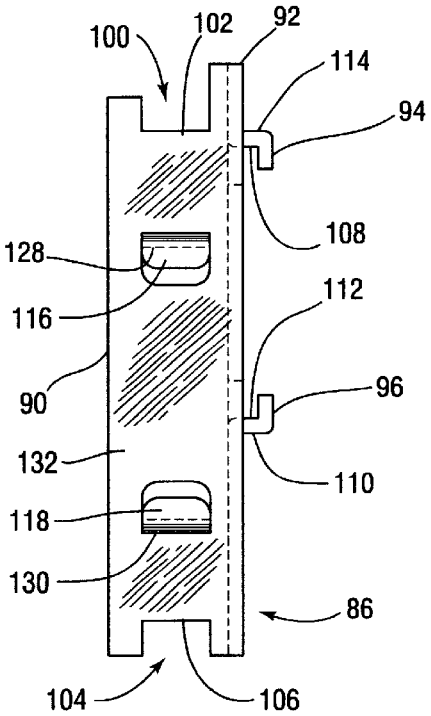
FIG. 5 is a side view of the L-shaped shelf hanging clip shown in FIG. 3, depicting on the two substantially rectangular sides of that clip.
Figure 6:
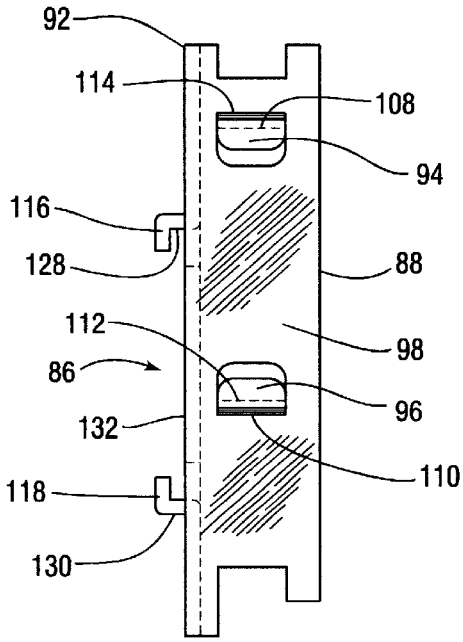
FIG. 6 is a side view of the L-shaped shelf hanging clip shown in FIG. 3 depicting the second substantially rectangular side of that clip.

To better understand the application of this invention to the support of shelves of a storage rack system, refer to FIG. 2 which shows a section of a gravity flow rack system 52. The rack system 52 has a pair of front vertical columns 54, a pair of mid vertical columns 56 and a pair of rear vertical columns 58. Upper front connecting beam 60 and lower front connecting beam 62 separate the front vertical columns 54, and upper rear connecting beam 64 and lower rear connecting beam 66 separate the rear vertical columns 58. Upper side connecting beams 68 interconnect and hold the tops of the front, mid and rear vertical columns 54, 56 and 58, respectively, while the lower side connecting beams 70 interconnect and hold the bottoms of these columns.

The vertical columns 54, 56 and 58 are made of plate steel which is bent into a tubular form having a rectangular cross-sectional configuration. The vertical columns are designed to support a particular maximum load. Each of the vertical columns 54, 56 and 58 shown in FIG. 2 has a front face 72 which has two rows of beam attachment holes formed in it and has side faces 74, each of which has a row of side shelf adjustment holes 75 in it. The adjustable shelf hanging clip of this invention is attached to the vertical columns 54, 56 and 58 through the side shelf adjustment holes 75.

A plurality of vertically-spaced gravity flow shelves 76 are supported by the columns 54, 56 and 58. Each of these shelves 76 includes a pair of side members 78 which are separated by front and rear cross members 80. Each shelf 76 is shown by way of example to include four tracks of rollers 82. The rollers enable packages 84 to roll from the rear to the front of the shelves 76 due to the force of gravity as packages are placed on the shelves 76 of the rack system 52 and/or as packages at the front of the shelves 76 are picked from the shelves.

An adjustable shelf hanging clip 86 made in accordance with this invention is used to support the side members 78 of the shelves 76 at each of the columns 54, 56 and 58. One preferred embodiment of an adjustable shelf hanging clip of this invention is shown in FIGS. 3–6. The shelf hanging clip 86 is made up of a plurality of generally rectangular sections made of metallic plate which are shown as sections 88 and 90 in FIGS. 3–6. The rectangular section 88 is joined to the rectangular section 90 through a corner 92 as a result of a bending of the plate out of which the shelf hanging clip 86 is constructed. The embodiment of this invention shown in FIGS. 3–6 is two sided, and its generally rectangular sections 88 and 90 have been bent into a 90° angle so that the shelf hanging clip 88 is L-shaped. The shelf hanging clip 86 could be bent so that the sections 88 and 90 form any angle less than 180° which is suitable for a particular application of the shelf hanging clip 86. However, it is believed the 90° angle will be used for most applications of this invention. Additionally, as pointed out below, shelf hanging clips made in accordance with this invention can have more than two substantially rectangular sections.

The rectangular section 88 has a pair of hook-shaped tabs 94 and 96 extending from its outside surface 98. The end of each of the tabs 94 and 96 extends in a direction toward the other tab. The tabs 94 and 96 are punched out of the plate material that the section 88 is made out of. However, tabs 88 and 90 could be made separately from the section 88 and attached to it by welding or by drilling tapped holes in the section 88 and adding a screw thread to the end of the tabs. The rectangular section 90 has a notch 100 having a bottom surface 102 at the end of that section which is proximate the tab 94. Rectangular section 90 also has a notch 104 with a bottom surface 106 at the end of the section which is proximate the tab 96. The purpose of the notches 100 and 104 is to receive and retain the bottom of a side member 78 of the shelves 76 shown in FIG. 2.

Referring once again to FIGS. 3–6, when the shelf hanging clip 86 is used with the tab 94 in the upper position, the tab 94 has a bearing surface 108 which is the flat upper portion 108 of the underside of the hook-like structure of the tab. However, in accordance with this invention the end of the tab 96 points toward the end of the tab 94. Thus, the bearing surface of the tab 96 is the lower flat outside surface 110 of the tab 96 which is adjacent the surface 98 of the rectangular section 88. The bearing surfaces 108 and 110 are spaced apart at a distance equal to the distance between the self adjustment holes in the vertical rack columns which are to be used to mount the shelf hanging clips 88 on the columns. The bearing surface 108 is at approximately the same level as the lower surface 102 of the notch 100. Thus, when the tab 94 is inserted into a shelf adjustment hole, the bearing surface 108 rests on the lower surface of the hole. The bearing surface 110 of the tab 96 rests on the bottom surface of the shelf adjustment hole into which it is inserted. As a result, the shelf hanging clip 86 is mounted on a vertical column in a manner such that the lower surface 102 of the notch 100 is approximately at the level of the lower surface of the shelf adjustment hole into which the tab 94 has been inserted. The side member 78 of a shelf 76 shown in FIG. 2 can be rested on the bottom surface 102 to hold the shelf at that level.

If the clip 86 is turned over, the tab 96 will then be at the top of the shelf hanging clip 86. The flat inside surface 112 of the tab 96 then becomes a bearing surface which contacts the bottom surface of a shelf adjustment hole into which the tab 96 is mounted. What is then the lower, outside flat surface 114 of the tab 94 becomes the bearing surface of the shelf adjusting hole into which the tab 94 is inserted. The bearing surface 112 is a predetermined longitudinal distance from the bottom surface 106 of the notch 104. When the shelf hanging clip 86 is turned over and the tab 96 clamps onto the shelf adjustment hole into which it is mounted, the bearing surface 114 contacts the lower surface of the shelf adjustment hole into which it is mounted. As a result, the bottom surface 106 of the notch 104 of the rectangular section is the preselected distance above the lower surface of the shelf adjustment hole into which the tab 96 has been inserted. When a side member 78 is placed on the bottom surface 106 of the notch 104, the shelf will be held the predetermined distance above the lower surface of the shelf adjustment hole into which the tab 96 has been inserted.

In a similar manner, the rectangular section 90 has a pair of hook-shaped tabs 116 and 118 which are proximate a bottom surface 120 of a notch 122 and a bottom surface 124 of a notch 126, respectively, at the opposite ends of the adjacent rectangular section 88. The structure and functions of the hook-shaped tabs 116 and 118 are identical to the structure and function of the tabs 94 and 96. Thus, the tab 116 has a bearing surface 128 which is the flat upper portion of the underside of the hook-like structure of the tab 116. When tab 118 is used in its lower position, a bearing surface 130 is located on a lower flat outside surface of the tab 118. This surface 130 is adjacent the surface 132 of the rectangular section 90 out of which the tabs 116 and 118 extend.

Figure 7:
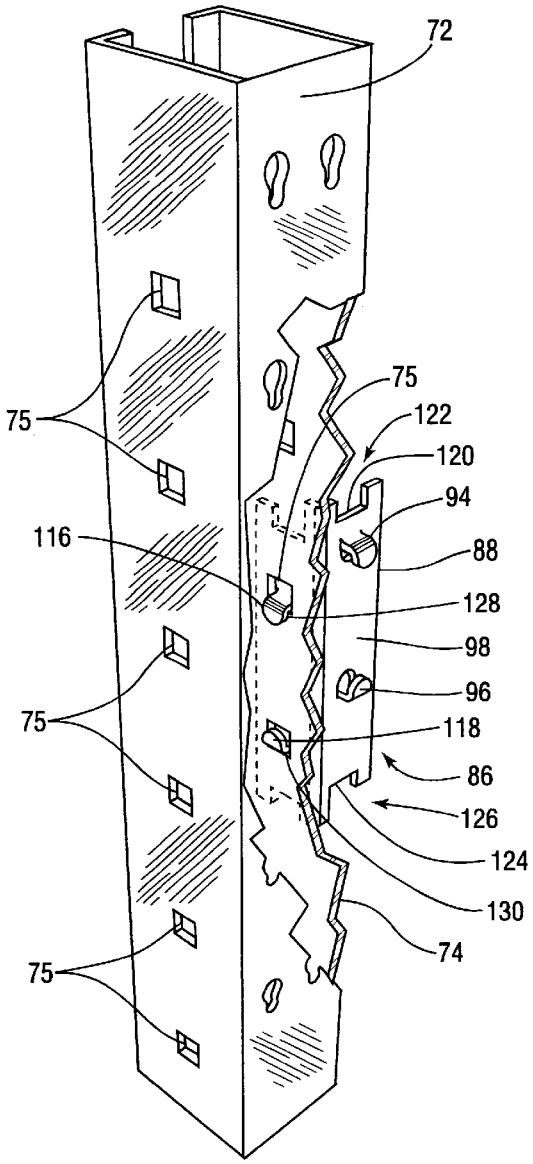
FIG. 7 is a cut-away view of a portion of FIG. 2 showing how tabs of the shelf hanging clip of this invention fit into shelf adjustment holes in a vertical rack column.

Refer to FIG. 7 for a clearer understanding of how the shelf hanging clip 86 of this invention is used on a vertical rack column 54, a section of which is shown in that figure. It can be seen that the rectangular section 90 is placed against a side 74 of the vertical column 54 as the tabs 116 and 118 are inserted into side shelf adjustment holes 75. After the insertion has been made the bearing surface 128 of the tab 116 contacts the bottom of the side shelf adjustment hole 75 into which the tab 116 has been inserted, and the bearing surface 130 of the tab 118 contacts the bottom of the side shelf adjustment hole 75 into which the tab 118 has been inserted. The shelf hanging clip 86 is ready to support a shelf.

Figure 8:
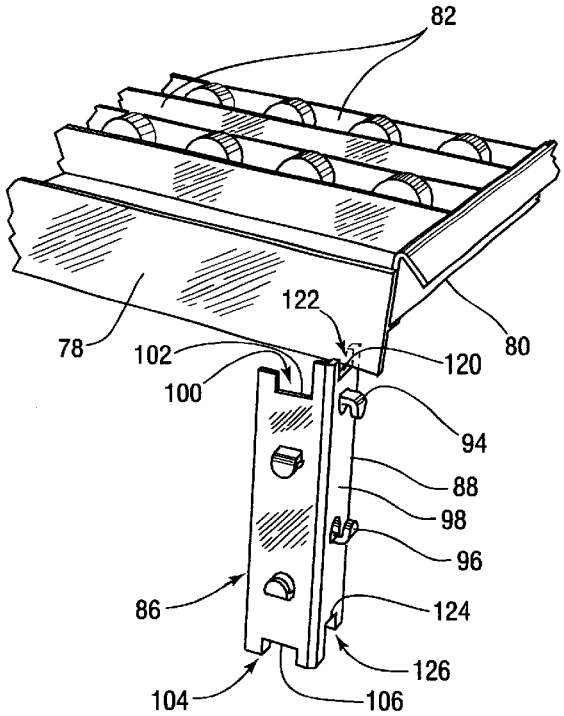
FIG. 8 is a cut-away view of a portion of FIG. 2 showing the interface between the side rail of a shelf and a notch on the shelf hanging clip of this invention.
Figure 9:
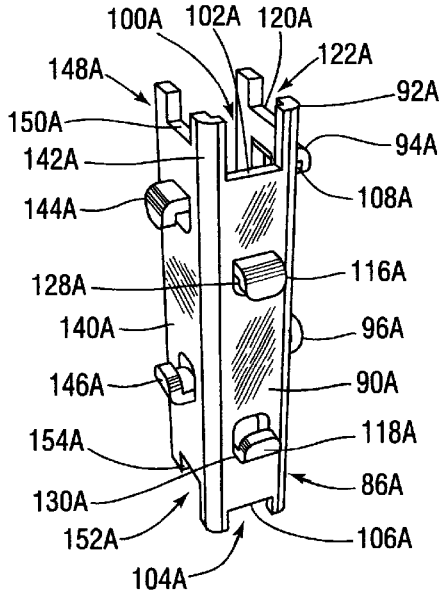
FIG. 9 is a perspective view of a U-shaped shelf hanging clip made in accordance with this invention.
Figure 10:
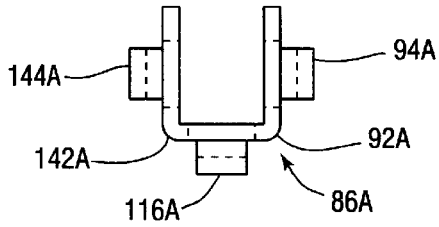
FIG. 10 is a top view of the U-shaped shelf hanging clip shown in FIG. 9.
Figure 11:
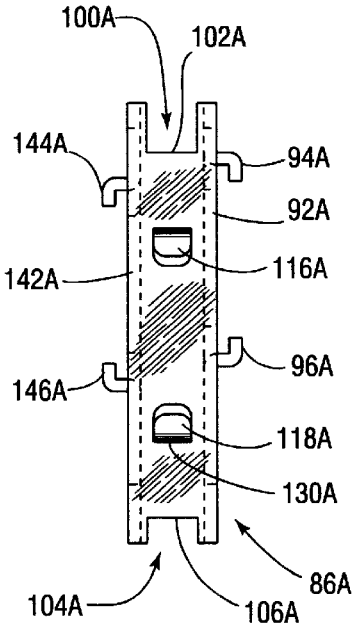
FIG. 11 is a side view of the U-shaped shelf hanging clip shown in FIG. 9 depicting one of the three substantially rectangular sides of that clip.
Figure 12:
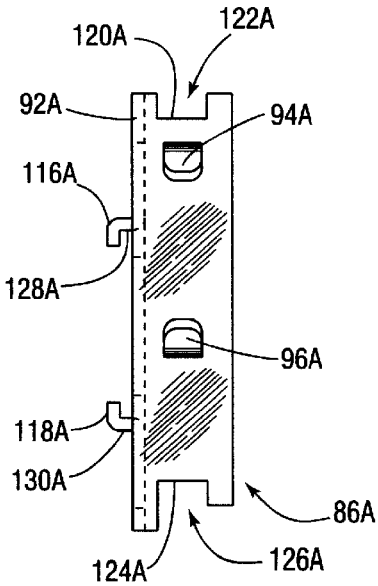
FIG. 12 is a side view of the U-shaped shelf hanging clip shown in FIG. 9 depicting a second side of that clip.
Figure 13:
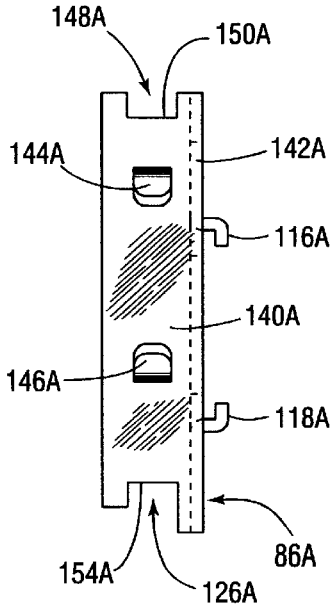
FIG. 13 is a side view of the U-shaped shelf hanging clip shown in FIG. 9 depicting a third of the three substantially rectangular sections of that clip.

FIG. 8 shows the manner in which a side member 78 of a shelf 76 is mounted within the slot 120 of notch 122 at the upper end of the rectangular member 88 of the shelf hanging clip 86. Typically, side members have one or more notches at the front or rear of the bottom of a side member 78 to aid in holding the side member on a hanger bracket or hanging clip.

There are numerous variations of the hanger clip 86 which can be made within the spirit and scope of this invention. By way of example, FIGS. 9–13 show a three sided U-shaped shelf hanging clip constructed in accordance with the principles of this invention. The parts of the shelf hanger clip 86A which are common with the L-shaped shelf hanging clip 86 shown in FIGS. 3–6 are marked with the same numerals used in those figures followed by the suffix "A." The U-shaped shelf hanging clip 86A includes a third substantially rectangular side 140A connected to the side 90A through a corner 142A. The rectangular side 140A has a pair of hook-shaped tabs 144A and 146A extending out of its surface. In accordance with the principles of this invention, the ends of the tabs 144A and 146A extend toward one another. The rectangular section 140A has a notch 148A with a bottom surface 150A. The other end of the rectangular section 140A has a notch 152A having a bottom surface 154A. The tabs and notches shown in FIGS. 9–13 function in the same manner described above with respect to the tabs and notches of the shelf hanging clip 86 shown in FIGS. 3–6.

It will be evident to those skilled in the art that a U-shaped shelf hanging clip could be constructed by eliminating the tabs 116A and 118A shown in FIGS. 9–13. This would result in a U-shaped shelf hanging clip which could mount a shelf at four different levels, rather than six. While it may be desirable for some applications of this invention, it would have the obvious disadvantage of using more material than the L-shaped shelf hanging clip 86 shown in FIGS. 3–6.

Those skilled in the art will recognize that this invention has been explained with regard to the details and arrangements of certain specific embodiments which have been described and illustrated to explain the nature of this invention. Modifications can be made to this invention by those skilled in the art without departing from its spirit and scope. Thus, the appended claims are intended to be interpreted to cover such equivalent shelf hanging clips which do not depart from the spirit and scope of this invention.

What is claimed is:

1. A shelf hanging clip comprising:

a plurality of generally rectangular sections; said plurality of rectangular sections including a first rectangular section joined to a second rectangular section through a corner to form an angle of less than 180°;

said first rectangular section including first and second support and latching tabs each having a hook-like shape and located in a line with one another parallel with said corner; each of said tabs having a distal end extending from a surface of said first rectangular section exterior of said angle and in a direction toward the other tab;

said second rectangular section having a first end proximate said first tab of said first rectangular section and a second end proximate said second tab of said first rectangular section; a first notch having a bottom surface formed in said first end and a second notch having a bottom surface formed in said second end; said bottom surface of said first notch being a first preselected longitudinal distance from said first tab and said bottom surface of said second notch being a second preselected longitudinal distance from said second tab.

2. A shelf hanging clip according to claim 1 in which said second rectangular section includes third and fourth support and latching tabs each having a hook-like shape and located in line with one another parallel with said corner; each of said third and fourth tabs having a distal end extending from a surface of said second rectangular section exterior of said angle and in a direction toward the other of said third and fourth tabs;

said first rectangular section having a third tab end proximate said third tab and a fourth tab end proximate said fourth tab; a third notch having a bottom surface formed in said third tab end and a fourth notch having a bottom surface formed in said fourth tab end; said bottom surface of said third notch being a third preselected longitudinal distance from said third tab and said bottom surface of said fourth notch being a fourth preselected longitudinal distance from said fourth tab.

3. A shelf hanging clip according to claim 2 in which said first rectangular section is joined to said second rectangular section through a corner which forms an angle of about 90°.

4. A shelf hanging clip according to claim 2 in which said plurality of rectangular sections includes a third rectangular section joined to said second rectangular section through a second corner to form an angle of less than 180° with said second rectangular section;

said third rectangular section including fifth and sixth support and latching tabs each having a hook-like shape and located in line with one another parallel with said corner; each of said fifth and sixth tabs having a distal end extending from a surface of said third rectangular section exterior of said second angle and in a direction toward the other of said fifth and sixth tabs;

said first end of said second rectangular section is proximate said fifth tab and said second end of said second rectangular section is proximate said sixth tab; said bottom surface of said first notch in said first end being a fifth preselected distance from said fifth tab and said bottom surface of said second notch being a sixth preselected distance from said sixth tab.

5. A shelf hanging clip according to claim 4 in which said corner between said first rectangular section and said second rectangular section and said second corner between said second rectangular section and said third rectangular section each forms an angle of about 90°.

6. A shelf hanging clip according to claim 4 which is to be inserted into a pair of vertically spaced holes in a vertical rack column and in which each latching tab has an inside bearing surface which is at the top of the inside of said hook-like shape when the distal end of said hook is pointing in a downward direction and an outside bearing surface on the outside of said tab opposite said inside bearing surface; each pair of latching tabs on each rectangular surface being spaced apart a distance which enables said inside bearing surface of an upper tab of said pair of tabs when said shelf hanging clip is installed to contact the bottom of a first hole in the vertical rack column and also enables said outside bearing surface of the lower tab of said pair of tabs to contact the bottom of a hole on the vertical rack column which is beneath the first hole so that said hook-like shape of said upper tab holds said shelf hanging clip in the vertical rack column and said lower tab assists said upper tab in supporting a load on said hanging clip.

7. A shelf hanging clip according to claim 2 which is to be inserted into a pair of vertically spaced holes in a vertical rack column and in which each latching tab has an inside bearing surface which is at the top of the inside of said hook-like shape when the distal end of said hook is pointing in a downward direction and an outside bearing surface on the outside of said tab opposite said inside bearing surface; each pair of latching tabs on each rectangular surface being spaced apart a distance which enables said inside bearing surface of an upper tab of said pair of tabs when said shelf hanging clip is installed to contact the bottom of a first hole in the vertical rack column and also enables said outside bearing surface of the lower tab of said pair of tabs to contact the bottom of a hole on the vertical rack column which is beneath the first hole so that said hook-like shape of said upper tab holds said shelf hanging clip in the vertical rack column and said lower tab assists said upper tab in supporting a load on said hanging clip.

8. A shelf hanging clip according to claim 1 in which said first rectangular section is joined to said second rectangular section through a corner which forms an angle of about 90°.

9. A shelf hanging clip according to claim 1 which is to be installed into a pair of vertically spaced holes in a vertical rack column and in which each latching tab has an inside bearing surface which is at the top of the inside of said hook-like shape of said tab when the distal end of said tab is pointing in a downward direction and an outside bearing surface on the outside of said hook-like shape opposite said inside bearing surface; said first and second latching tabs being spaced apart a distance which enables said inside bearing surface of said first tab to contact the bottom of a first hole in the vertical rack column when said first tab is above the second tab when said shelf hanging clip is installed and also enables said outside bearing surface of said second tab to contact the bottom of a hole on the vertical rack column which is below the first hole so that said hook-like shape of said first tab holds said shelf hanging clip on the vertical rack column and said second tab assists said first tab in supporting a load on said shelf hanging clip.

10. A shelf hanging clip according to claim 1 in which said plurality of rectangular sections includes a third rectangular section joined to said second rectangular section through a second corner to form an angle with said second rectangular section;

said third rectangular section including third and fourth support and latching tabs each having a hook-like shape and located in line with one another parallel with said corner; each of said third and fourth tabs having a distal end extending from a surface of said third rectangular section exterior of said second angle and in a direction toward the other of said third and fourth tabs;

said first end of said second rectangular section is proximate said third tab and said second end of said second rectangular section is proximate said fourth tab; said bottom surface of said first notch in said first end being a third preselected distance from said third tab and said bottom surface of said second notch being a fourth preselected distance from said fourth tab.

11. A shelf hanging clip according to claim 10 in which said corner between said first rectangular section and said second rectangular section and said second corner between said second rectangular section and said third rectangular section each forms an angle of about 90°.

12. A shelf hanging clip according to claim 10 which is to be inserted into a pair of vertically spaced holes in a vertical rack column and in which each latching tab has an inside bearing surface which is at the top of the inside of said hook-like shape when the distal end of said hook is pointing in a downward direction and an outside bearing surface on the outside of said tab opposite said inside bearing surface; each pair of latching tabs on each rectangular surface being spaced apart a distance which enables said inside bearing surface of an upper tab of said pair of tabs when said shelf hanging clip is installed to contact the bottom of a first hole in the vertical rack column and also enables said outside bearing surface of the lower tab of said pair of tabs to contact the bottom of a hole on the vertical rack column which is beneath the first hole so that said hook-like shape of said upper tab holds said shelf hanging clip in the vertical rack column and said lower tab assists said upper tab in supporting a load on said hanging clip.

13. A shelf hanging clip which is to be inserted into a pair of vertically spaced holes in a vertical rack column comprising:

a plurality of generally rectangular sections; said plurality of rectangular sections including a first rectangular section joined to a second rectangular section through a corner to form an angle of about 90°;

said first rectangular section including first and second support and latching tabs each having a hook-like shape and located in a line with one another parallel with said corner; each of said tabs having a distal end extending from a surface of said first rectangular section exterior of said angle and in a direction toward the other tab;

said second rectangular section having a first end proximate said first tab of said first rectangular section and a second end proximate said second tab of said first rectangular section; a first notch having a bottom surface formed in said first end and a second notch having a bottom surface formed in said second end; said bottom surface of said first notch being a first preselected longitudinal distance from said first tab and said bottom surface of said second notch being a second preselected longitudinal distance from said second tab;

said second rectangular section including third and fourth support and latching tabs each having a hook-like shape and located in line with one another parallel with said corner; each of said third and fourth tabs having a distal end extending from a surface of said second rectangular section exterior of said angle and in a direction toward the other of said third and fourth tabs;

said first rectangular section having a third tab end proximate said third tab and a fourth tab end proximate said fourth tab; a third notch having a bottom surface formed in said third tab end and a fourth notch having a bottom surface formed in said fourth tab end; said bottom surface of said third notch being a third preselected longitudinal distance from said third tab and said bottom surface of said fourth notch being a fourth preselected longitudinal distance from said fourth tab;

each latching tab having an inside bearing surface which is at the top of the inside of said hook-like shape when the distal end of said hook is pointing in a downward direction and an outside bearing surface on the outside of said tab opposite said inside bearing surface; each pair of latching tabs on each rectangular surface being spaced apart a distance which enables said inside bearing surface of an upper tab of said pair of tabs when said shelf hanging clip is installed to contact the bottom of a first hole in the vertical rack column and also enables said outside bearing surface of the lower tab of said pair of tabs to contact the bottom of a hole on the vertical rack column which is beneath the first hole go that said hook-like shape of said upper tab holds said shelf hanging clip in the vertical rack column and said lower tab assists said upper tab in supporting a load on said hanging clip.

* * * * *